US005726402A

United States Patent [19]

Katz et al.

[11] Patent Number: 5,726,402

[45] Date of Patent: Mar. 10, 1998

[54] LID SWITCH ASSEMBLY FOR A COIN OPERATED APPLIANCE

[75] Inventors: Jonathan Marc Katz; Marcus Malik Hammonds; Daniel Leon Pawlicki, all of Louisville, Ky.

[73] Assignee: General Electric Company, Louisville, Ky.

[21] Appl. No.: 726,532

[22] Filed: Oct. 7, 1996

[51] Int. Cl.[6] ..... H01H 3/16; D06F 39/00

[52] U.S. Cl. ..... 200/61.7; 200/61.62; 68/12.26

[58] Field of Search ..... 200/52 R, 61.58 R, 200/61.62, 61.7, 61.76, 83 WM; 68/12.26, 23.3; 192/135, 136

[56] References Cited

U.S. PATENT DOCUMENTS

| | | | |
|---|---|---|---|
| 2,882,360 | 4/1959 | Sisson | 200/61.7 |
| 3,440,373 | 4/1969 | Blewitt, Jr. | 200/61.7 |
| 3,455,425 | 7/1969 | Douglas | 194/9 |
| 3,736,772 | 6/1973 | Baker . | |
| 3,763,670 | 10/1973 | Harrold | 68/12 R |
| 4,264,793 | 4/1981 | Mailloux | 200/61.62 |
| 4,365,830 | 12/1982 | Paulson | 292/89 |
| 4,449,383 | 5/1984 | Cartier . | |
| 4,493,410 | 1/1985 | Nelson | 194/1 G |
| 5,001,910 | 3/1991 | Harmelink et al. . | |
| 5,050,407 | 9/1991 | Wild | 68/12.06 |
| 5,440,086 | 8/1995 | Kropf | 200/61.62 |
| 5,600,976 | 2/1997 | Hapke et al. | 68/12.26 |

*Primary Examiner*—Michael L. Gellner
*Assistant Examiner*—Michael J. Hayes
*Attorney, Agent, or Firm*—H. Neil Houser

[57] ABSTRACT

A lid switch assembly including a lid switch configured to be substantially located within a coin box of a coin operated appliance is described. In one embodiment, the lid switch assembly is configured for use in connection with a coin operated washing machine including a lid rotatably mounted to a washer cover and a coin box mounted to the washer cover adjacent the lid. The lid switch assembly includes a hinge rod secured to the lid and rotatable with the lid. The hinge rod includes an actuating arm configured to be substantially located within the coin box. The lid switch assembly also includes a switch configured to be mounted within the coin box. The switch is electrically connected in series with a power source and the washing machine motor. As the washing machine lid is opened, the hinge rod actuating arm rotates so that the switch actuator moves. Once the washing machine lid has been opened a predetermined distance, the hinge rod actuating arm sufficiently rotates so that the switch is in the non-conducting state. Regardless of whether proper coins have been deposited and whether the operator start button is depressed, when the switch is in the non-conducting state, the switch prevents energy from being be supplied to the motor and washing machine operations stop.

20 Claims, 2 Drawing Sheets

LID SWITCH ASSEMBLY FOR A COIN OPERATED APPLIANCE

FIELD OF THE INVENTION

This invention relates generally to coin operated appliances and, more particularly, to a tamper proof lid switch for a coin operated washing machine.

BACKGROUND OF THE INVENTION

Known coin operated washing machines include a lid switch which is in a conducting state if the washing machine lid is closed, and when the lid switch is in the conducting state, the washing machine motor may be energized. As the lid is rotated from a closed position to an open position, and once the lid is opened beyond a predetermined distance, the lid switch changes from the conducting state to a non-conducting state. When the lid switch is in the non-conducting state, the switch prevents energization of the washing machine motor. The lid switch is provided to prevent washing machine operation when the lid is opened beyond a predetermined distance.

Known lid switches typically include a spring biased actuator, and in one known configuration, the switch is mounted to washing machine cover so that the actuator contacts the washing machine lid. When the lid is closed, the lid presses against the switch actuator and the switch is in a closed, conducting condition. As the lid is opened, the portion of the lid which contacts the actuator rotates away from the switch actuator. Since the actuator is spring biased outward, the actuator is forced towards the lid as the lid portion rotates away from the switch. Once the lid has been opened to a predetermined distance, the actuator moves a sufficient distance outward so that the switch opens and is in a non-conducting state. As described above, when the switch opens, the switch interrupts, or prevents, the energization of the washing machine motor. As an example, with a known lid switch, if the washing machine lid is opened to or beyond 1.995 inches as measured from the front peripheral edge of the washing machine door to the substantially planar washer cover surface, the lid switch opens and prevents energization of the washing machine motor.

The above described lid switch has proven effective for controlling energization of the washing machine motor in the event that the lid is open or is being opened during machine operation. The lid switch, however, is susceptible to tampering since the switch actuator is easily accessible. For example, the actuator can be jammed in a closed condition so that when an operator opens the washing machine lid, the actuator remains in the closed condition. Of course, if the actuator remains in the closed condition, the washing machine motor remains energized even though the washing machine lid is open. It generally is undesirable to continue washing machine operations when the washing machine lid is opened beyond a predetermined distance.

It would be desirable to provide a tamper proof lid switch that is not as easily accessible as known lid switches. Such a tamper proof lid switch, however, should be easy to assemble and install, and not add significant cost to the washing machine.

SUMMARY OF THE INVENTION

These and other objects may be attained in a lid switch assembly including a lid switch configured to be substantially located within a coin box of a coin operated appliance. More specifically, and in accordance with one embodiment of the present invention, the lid switch assembly is configured for use in connection with a coin operated washing machine including a lid rotatably mounted to a washer cover and a coin box mounted to the washer cover adjacent the lid. The lid switch assembly includes a hinge rod secured to the lid and rotatable with the lid. The hinge rod includes an actuating arm configured to be substantially located within the coin box.

The lid switch assembly also includes a switch configured to be mounted within the coin box. The switch is to be electrically connected in series with a power source and the washing machine motor so that when the switch is closed, energy may be supplied to the motor. Of course, in order for energy to be supplied to the washing machine motor, certain other conditions must also be satisfied, e.g., proper coins deposited in the coin box. When the switch is opened, energy may not be supplied, or is cut-off, to the motor. The switch, by itself and regardless of whether proper coins have been deposited and whether the operator start button is depressed, prevents energy from being be supplied to the motor in the event that the washing machine lid is opened.

The switch includes a switch actuator movable from and between a first position and a second position. The switch actuator is biased to be in the second position. The switch is in a conducting state (i.e., closed) when the switch actuator is in the first position, and the switch is in a non-conducting state (i.e., opened) when the switch actuator is in the second position. The switch actuator is positioned so that when the washing machine lid is closed, the hinge rod actuating arm acts against the switch actuator and holds the switch actuator in the first position.

As the washing machine lid is opened, the hinge rod actuating arm rotates so that the switch actuator moves from the first position towards the second position. Once the washing machine lid has been opened a predetermined distance, the hinge rod actuating arm sufficiently rotates so that the switch is in the non-conducting state. Regardless of whether proper coins have been deposited and whether the operator start button is depressed, when the switch is in the non-conducting state, the switch prevents energy from being be supplied to the motor and washing machine operations stop.

Tampering with the above described lid switch assembly is believed to be extremely difficult, if not impossible, since the assembly is substantially located within the coin box. Since the coin box typically is locked, and since breaking into the coin box requires substantial effort, this lid switch assembly is believed to be substantially tamper proof. In addition, the lid switch assembly is easy to assemble and install, and does not add significant cost to washing machine.

DETAILED DESCRIPTION OF THE DRAWINGS

Figure 1:
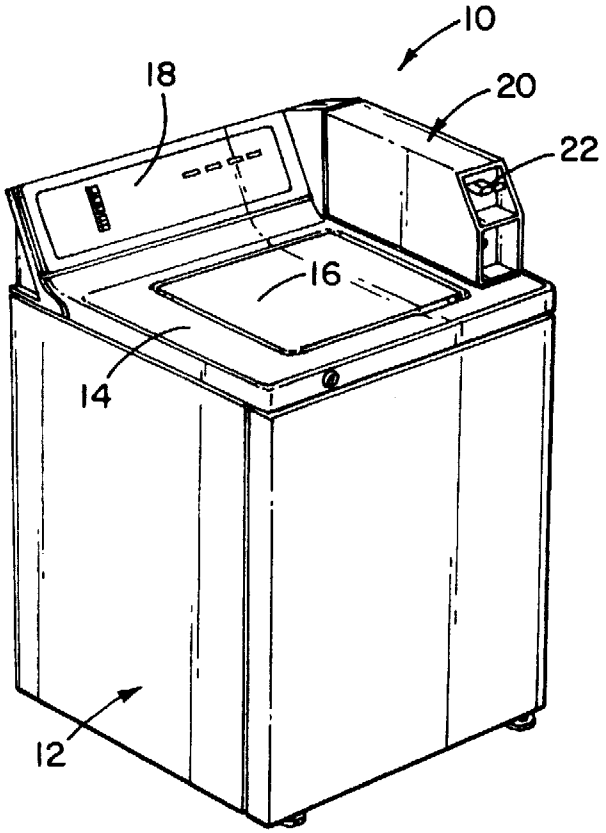
FIG. 1 is a perspective view of a coin operated washing machine.

FIG. 1 is a perspective view of an exemplary coin operated washing machine 10. Washing machine 10 is shown for illustrative purposes only and not by way of limitation. The present lid switch assembly can be utilized in connection with many other coin operated washing machines and other appliances. Washing machine 10 includes a cabinet 12 having a washer cover 14, and a lid 16 is rotatably mounted to washer cover 14. As is well known in the art, a washing unit (not shown) is mounted within cabinet 12. Washing machine 10 also includes a control panel 18. A coin box 20 is mounted to washer cover 14 adjacent lid 16. Coin box 20 includes a coin deposit unit 22 so that an operator can make a required deposit for operation of washing machine 10.

Figure 2:
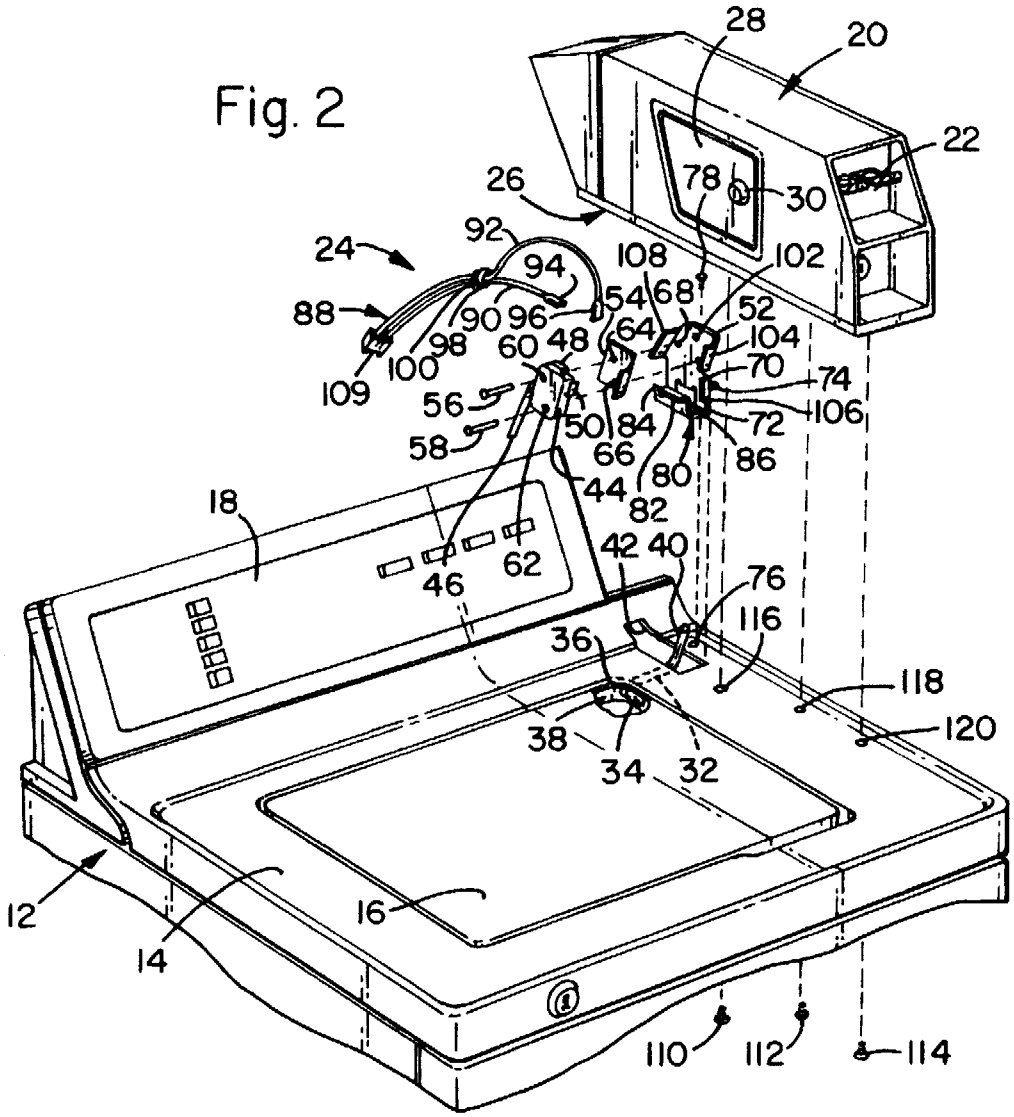
FIG. 2 is an exploded view of the coin box and washing machine, with parts cut-away, shown in FIG. 1.

FIG. 2 is an exploded view of washing machine 10, with parts cutaway, shown in FIG. 1. Specifically, as shown in FIG. 2, washing machine 10 includes a lid switch assembly 24 and coin box 20 having an open bottom 26 so that components of assembly 24 can be substantially located, and secured, within coin box 20. Coin box 20 further includes an access door 28 having a keyed lock 30 secured thereto. When secured to washer cover 14, the interior of coin box 20 can only be accessed through door 28.

Lid switch assembly 24 is secured to washer cover 14 and includes a hinge rod 32 secured to lid 14 by bolts 34. Specifically, hinge rod 32 includes a lid engagement portion 36 in contact with an inner flange 38 of lid 16. Bolts 34 extend through aligned openings in hinge rod lid engagement portion 36 and flange 38, and bolts 34 secure hinge rod 32 to lid 16. Hinge rod 32 also includes an actuating arm 40 extending through an opening 42 in washer cover 14 and configured to be substantially located within coin box 20. As can be seen in FIG. 2, as lid 16 is rotated open, hinge rod actuating arm 40 also rotates.

Lid switch assembly 24 further includes a switch 44 configured to be mounted within coin box 20, and switch 44 includes a switch actuator 46 and first and second blade contacts 48 and 50. Switch 44 is mounted to a switch bracket 52. An insulator 54 is located between switch bracket 52 and switch 44 to electrically isolate switch 44 from bracket 52. In the embodiment shown in FIG. 2, switch 44 and insulator 54 are mounted to switch bracket 52 by rivets 56 and 58 which extend through openings 60 and 62 in switch 44, and aligned respective openings 64, 66, 68 and 70 in insulator 54 and bracket 52.

Switch bracket 52 includes a locator slot 72 which aligns with opening 42 in washer cover 14. As described hereinafter in more detail, hinge rod 32 extends through opening 42 and locator slot 72, and into contact with switch actuator 46. Bracket 52 further includes a mounting flange 74 having an opening (not shown in FIG. 2) which aligns with an opening 76 in washer cover 14. A threaded bolt 78 extends through the aligned openings and substantially secures bracket 52 to washer cover 14. Bracket 52 further includes a brace 80 for contacting washer cover 14 and providing stability for lid switch assembly 24. Brace 80 includes a flange 82 and dog ear cut-outs 84 and 86 which trap a portion of washer cover 14 therebetween.

Lid switch assembly 24 also includes a wire harness 88 including first and second conductors 90 and 92. Insulated terminals 94 and 96 are secured to conductors 90 and 92, and insulated terminals 94 and 96 connect to respective blade contacts 48 and 50 of switch 44. Clip 98, generally referred to in the art as "christmas tree" type clip, is secured to conductors 90 and 92 to keep conductors 90 and 92 away from switch 44, and an end 100 of clip 98 is configured to be inserted within an opening 102 in bracket 52. Bracket 52 also includes flanges, or guards 104, 106 and 108, for keeping conductors 90 and 92 away from switch actuator 46.

Wiring harness 88 also includes a connector 110 which is electrically connected to first and second conductors 90 and 92. In a typical connection, and by way of example, conductor 90 is electrically coupled to a power source and conductor 92 is electrically coupled to an electric motor (not shown) of washing machine 10. Switch 44, therefore, is electrically connected in series between the power source and the washing machine electric motor.

Washing machine 10 may, for example, be washing machine model number WCCB1030T6WC, commercially available from General Electric Company, Appliance Park, Louisville, Ky. 40225. Such washing machine would be modified to include opening 42 in washer cover 14. Coin box 20 may, for example be coin box model number 74-1063-X, commercially available from Greenwald, Brooklyn, N.Y. 11237, and is secured to washing cover 14 by bolts 110, 112 and 114 that extend through openings 116, 118 and 120 in cover 14 and openings (not shown) in coin box 20. Switch 44 may, for example, be a switch model number V7-6C27D837-31D, commercially available from Microswitch, Inc., Freeport, Ill., 61032. Insulator 54 may, for example, be of plastic or nomax type material. Hinge rod 32 and bracket 52 may, for example, be stainless steel. Bracket 52 may be formed, for example, by a stamping and bending operation.

Figure 3:
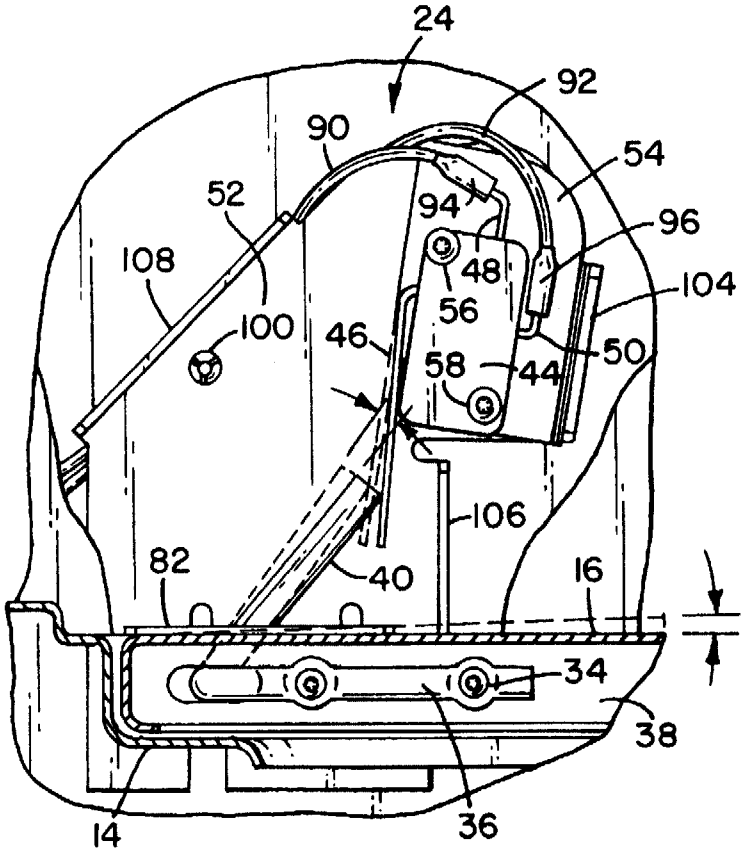
FIG. 3 is a partial cross section view of a lid switch assembly secured to a washing machine cover in accordance with one embodiment of the present invention.

FIG. 3 is a partial cross section view of lid switch assembly 24. As shown in FIG. 3, hinge rod actuating arm 40 acts against switch actuator 46. Switch actuator 46 has a first position (shown in solid line) and a second position (shown in phantom). Switch actuator 46 is biased to be in the second position. Switch 44 is in a conducting state when switch actuator 46 is in the first position, and switch 44 is in a non-conducting state when switch actuator 46 is in the second position.

Switch actuator 46 is positioned so that when washing machine lid 14 is closed, hinge rod actuating arm 40 acts against switch actuator 46 and holds switch actuator 46 in the first position. As washing machine lid 16 is opened, hinge rod actuating arm 40 rotates so that switch actuator 46 moves from the first position towards the second position. When washing machine lid 16 is opened to a predetermined distance, hinge rod actuating arm 40 sufficiently rotates so that switch 44 is in the non-conducting state.

In the embodiment described above, and since switch 44 is electrically in series between the power source and the washing machine motor, when lid 16 is closed and switch 44 is in the conducting state, the washing machine motor can be energized. Of course, in order for energy to be supplied to the washing machine motor, certain other conditions must also be satisfied, e.g., proper coins deposited in the coin box. When lid 16 is opened the predetermined distance, however, switch 44 opens and energy may not be supplied, or is cut-off, to the motor. Switch 44, by itself and regardless of whether proper coins have been deposited and whether the operator start button is depressed, prevents energy from being be supplied to the motor in the event that washing machine lid 16 is opened to the predetermined distance or beyond.

Figure 4:
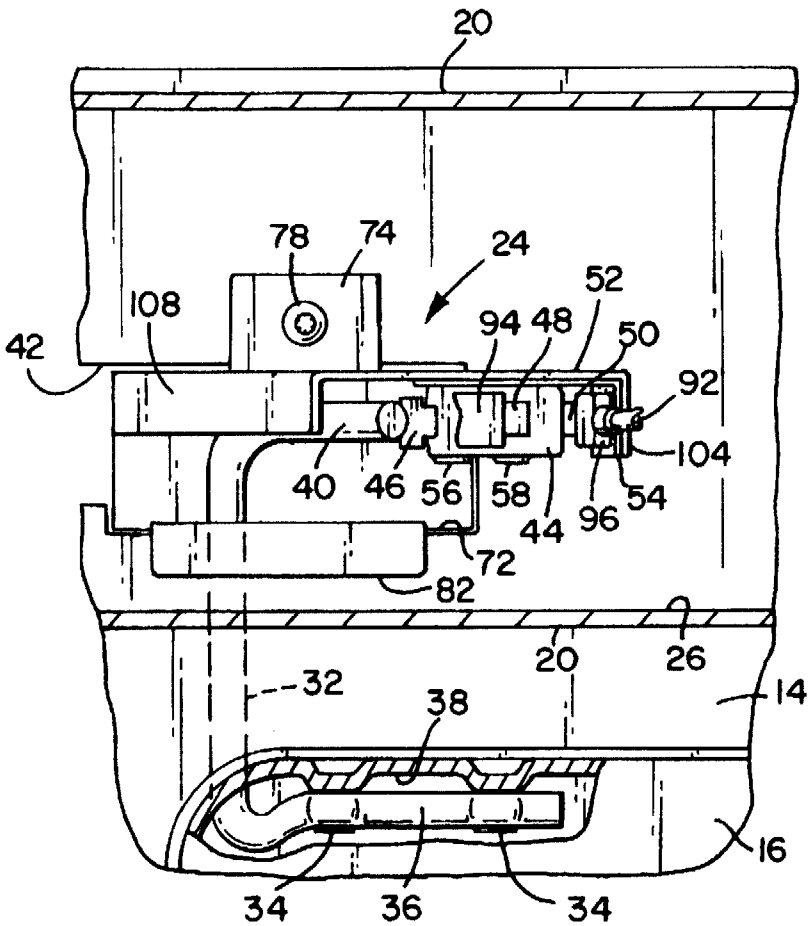
FIG. 4 is a top view of the lid switch assembly shown in FIG. 3.

FIG. 4 is a top view of lid switch assembly 24 shown in FIG. 3, with parts cut away. As clearly shown in FIG. 4, hinge rod 32 extends through locator slot 72 in bracket 52, and into contact with switch actuator 46. Also, mounting flange 74 and brace flange 82 for securing bracket 52 to washer cover 14 are clearly shown in FIG. 4.

Lid switch assembly 24 is believed to be substantially tamper proof since switch 44 and actuating arm 40 are substantially located within coin box 20. In addition, lid switch assembly 24 is easy to assemble and install, and does not add significant cost to washing machine 10.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A lid switch assembly for a coin operated washing machine, the washing machine including a lid rotatably mounted to a washer cover and a coin box mounted to the washer cover adjacent the lid, said lid switch assembly comprising:

a hinge rod secured to the lid and rotatable with the lid, said hinge rod comprising an actuating arm configured to be substantially located within the coin box; and a switch configured to be mounted within the coin box, said switch comprising a switch actuator movable from and between a first position and a second position, said switch actuator biased to be in said second position, said switch being in a conducting state when said switch actuator is in said first position, and said switch being in a non-conducting state when said switch actuator is in said second position, said switch actuator positioned so that when the washing machine lid is closed, said hinge rod actuating arm acts against said switch actuator and holds said switch actuator in said first position.

2. A lid switch assembly in accordance with claim 1 wherein said switch further comprises first and second blade contacts, and said lid switch assembly further comprises a wire harness comprising first and second conductors, said first and second conductors configured to be electrically connected to said first and second blade contacts.

3. A lid switch assembly in accordance with claim 1 further comprising a switch bracket, said switch mounted to said switch bracket, said switch bracket configured to be secured to the washer cover adjacent an opening in the washer cover, said hinge rod configured to extend through the washer cover opening.

4. A lid switch assembly in accordance with claim 3 wherein an insulator is located between said switch bracket and said switch.

5. A lid switch assembly in accordance with claim 3 wherein said switch bracket comprises a locator slot configured to align with the washer cover opening, said hinge rod configured to extend through said locator slot.

6. A lid switch assembly in accordance with claim 3 wherein said switch bracket further comprises a brace for contacting the washer cover, said brace comprising a flange and dog ear cut-outs configured to trap a portion of the washer cover therebetween.

7. A lid switch assembly in accordance with claim 1 wherein as the washing machine lid is opened, said hinge rod actuating arm rotates so that said switch actuator moves from said first position towards said second position.

8. A lid switch assembly in accordance with claim 7 wherein once the washing machine lid has been opened a predetermined distance, said hinge rod actuating arm sufficiently rotates so that said switch is in said non-conducting state.

9. A washing machine, comprising:

a cabinet comprising a washer cover;

a lid rotatably mounted to said washer cover;

a washing unit mounted within said cabinet;

a coin box mounted to said washer cover adjacent said lid; and a lid switch assembly, comprising:

a hinge rod secured to said lid and rotatable with said lid, said hinge rod comprising an actuating arm configured to be substantially located within said coin box; and a switch configured to be mounted within said coin box, said switch comprising a switch actuator having a first position and a second position, said switch biased to be in said second position, said switch being in a conducting state when said switch actuator is in said first position and said switch being in a non-conducting state when said switch actuator is in said second position, said switch actuator positioned so that when said washing machine lid is closed, said hinge rod actuating arm acts against said switch actuator and holds said switch actuator in said first position.

10. A washing machine in accordance with claim 9 wherein said switch further comprises first and second blade contacts, and said lid switch assembly further comprise a wire harness comprising first and second conductors, said first and second conductors electrically connected to said first and second blade contacts.

11. A washing machine in accordance with claim 9 further comprising a switch bracket, said switch mounted to said switch bracket, said switch bracket secured to said washer cover adjacent an opening in said washer cover, said hinge rod extending through said washer cover opening.

12. A washing machine in accordance with claim 11 wherein an insulator is located between said switch bracket and said switch.

13. A washing machine in accordance with claim 11 wherein said switch bracket comprises a locator slot aligned with said opening in said washer cover opening, said hinge rod extending through said locator slot.

14. A washing machine in accordance with claim 11 wherein said switch bracket further comprises a brace for contacting said washer cover, said brace comprising a flange and dog ear cut-outs which trap a portion of said washer cover therebetween.

15. A washing machine in accordance with claim 9 wherein as said washing machine lid is opened, said hinge rod actuating arm rotates so that said switch actuator moves from said first position towards said second position.

16. A washing machine in accordance with claim 15 wherein once said washing machine lid is opened to a predetermined distance, said hinge rod actuating arm sufficiently rotates so that said switch is in said non-conducting state.

17. A lid switch assembly for use in connection with a coin box and an apparatus having a rotatably mounted lid, said lid switch assembly comprising:

a hinge rod secured to the lid and rotatable with the lid, said hinge rod comprising an actuating arm configured to be substantially located within the coin box; and a switch mounted within the coin box, said switch comprising a switch actuator movable from and between a first position and a second position, said switch actuator biased to be in said second position, said switch being in a conducting state when said switch actuator is in said first position, and said switch being in a non-conducting state when said switch actuator is in said second position, said switch actuator positioned so that when the lid is closed, said hinge rod actuating arm acts against said switch actuator and holds said switch actuator in said first position.

18. A lid switch assembly in accordance with claim 17 wherein as the lid is opened, said hinge rod actuating arm rotates so that said switch actuator moves from said first position towards said second position.

19. A lid switch assembly in accordance with claim 18 wherein once the lid has been opened a predetermined distance, said hinge rod actuating arm sufficiently rotates so that said switch is in said non-conducting state.

20. A lid switch assembly in accordance with claim 17 wherein the coin box is mounted to the apparatus, and said hinge rod actuating arm extends through an opening in a wall of said apparatus and into the coin box.

* * * * *